US005350276A

United States Patent [19]

Gros

[11] Patent Number: 5,350,276

[45] Date of Patent: Sep. 27, 1994

[54] HIGH PRESSURE MODULES OF DRUM ROTOR TURBINES WITH ADMISSION OF STEAM HAVING VERY HIGH CHARACTERISTICS

[75] Inventor: Jean-Pierre Gros, Villemomble, France

[73] Assignee: GEC Alsthom Electromecanique SA, Paris, France

[21] Appl. No.: 47,192

[22] Filed: Apr. 16, 1993

[30] Foreign Application Priority Data

Apr. 17, 1992 [FR] France ..... 92 04812

[51] Int. Cl.[5] ..... F01D 1/04; F01D 5/06

[52] U.S. Cl. ..... 415/168.4; 415/199.5; 416/201 R

[58] Field of Search ..... 415/199.4, 199.5, 170.1, 415/168.1, 168.4, 174.5; 416/198 A, 210 R

[56] References Cited

U.S. PATENT DOCUMENTS

| | | | |
|---|---|---|---|
| 2,211,874 | 8/1940 | Wilson | 415/199.5 |
| 2,467,818 | 4/1949 | Elston | 415/174.5 |
| 2,743,080 | 4/1956 | Feilden | 416/198 A |
| 2,855,178 | 10/1958 | Forsyth et al. | 415/199.5 |
| 2,888,240 | 5/1959 | Fleischmann et al. | |
| 3,844,675 | 10/1974 | Remberg | 415/199.5 |
| 4,431,373 | 2/1984 | Monsarrat | 415/199.5 |

FOREIGN PATENT DOCUMENTS

| | | | |
|---|---|---|---|
| 0475771 | 3/1992 | European Pat. Off. | |
| 38382 | 2/1956 | Fed. Rep. of Germany | 415/170.1 |
| 1085715 | 7/1954 | France | |
| 1201991 | 1/1960 | France | |
| 1320174 | 1/1963 | France | |
| 111845 | 1/1926 | Switzerland | |
| 331946 | 9/1958 | Switzerland | |
| 618011 | 2/1949 | United Kingdom | 416/198 A |
| 1101305 | 1/1968 | United Kingdom | |
| 1335939 | 10/1973 | United Kingdom | 415/199.4 |
| 2138078 | 10/1984 | United Kingdom | |

*Primary Examiner*—Edward K. Look
*Assistant Examiner*—James A. Larson
*Attorney, Agent, or Firm*—Sughrue, Mion, Zinn, Macpeak & Seas

[57] ABSTRACT

An HP module for a turbine having a drum rotor with admission for steam having very high pressure and temperature characteristics comprises zones of different designs that are suitable for different temperature and pressure levels. An anterior zone A is at the steam admission end and includes a rotor assembly, diaphragms, an internal body, and an admission baffle carrier all of which are fully isotrophic, without any break in a horizontal join plane. A posterior zone P situated at the exhaust end has its internal body implemented in the form of two portions which are coupled to the internal body of the zone A. The internal body of the zone P may be isotropic and banded or it may be non-isotropic or it may be bolted. In the zone A the blades are mounted either in axial grooves or else in circumferential grooves, whereas in the zone P, the grooves are selected to be circumferential for simplification purposes. The advantage of the invention lies in a reduction in the transverse size of the module due:

to the drum rotor;

to the isotropic anterior interior body; and to elimination of the third envelope at the admission end.

10 Claims, 11 Drawing Sheets

HIGH PRESSURE MODULES OF DRUM ROTOR TURBINES WITH ADMISSION OF STEAM HAVING VERY HIGH CHARACTERISTICS

The present invention relates to improvements in the high pressure module of a turbine having an admission of steam with very high characteristics, a steam exhaust, a rotor supporting moving wheels constituted by moving blades, and stator portions including an outer body and an inner body supporting stationary stages disposed between the moving wheels, the inner body being provided at its admission end with a baffle-carrier for sealing the admission steam.

BACKGROUND OF THE INVENTION

The high pressure stator portions off a steam turbine also includes two envelopes constituted by the inner body and the outer body, together with a third envelope at the admission end when pressures and temperatures are very high.

Because of this multiplicity of envelopes, it is possible to reduce the differences of pressure and temperature between envelopes.

In addition, the inner and outer bodies are each made of two portions and are provided with flanges in the horizontal join plane to enable them to be bolted together.

The multiplicity of envelopes, and the presence of the horizontal joint plate flange for bolting-together the bodies lead:

to an increase in the transverse dimensions of the envelopes of the stator; and to said envelopes being non-isotropic.

This gives rise to an increase in forces and has an effect on the mechanical and thermal behavior of the envelopes and of their fastenings.

This problem is critical in the admission zone where pressure and temperature are very high.

In addition, for impulse steam turbines, the rotor is provided with disks supporting the moving blades, thereby considerably increasing the transverse dimensions of the bladed rotor, and consequently of the stator portions.

OBJECT AND SUMMARY OF THE INVENTION

The turbine module of the invention is of simplified design and its dimensions are reduced while still ensuring good mechanical and thermal behavior. According to the invention the internal body includes two coupled-together bodies, namely: an anterior body disposed at the admission end; and a posterior body disposed at the exhaust end; the anterior body being a single piece and surrounding a portion of the rotor which is a drum motor provided with grooves in which the roots of the blades are fixed.

By separating the internal body into two portions, namely an anterior portion and a posterior portion, it is possible to adapt each of the portions to the characteristics of the steam.

The anterior portion in which the temperature and pressure of the steam are very high includes an internal envelope and a sealing baffle-carrier at the admission which are isotropic and which therefore do not include fastening means.

Another effect of this disposition is to reduce the radial size of the passage and consequently that of the envelopes. Furthermore, such reduction in the radial size of the passage enhances efficiency, particularly for impulse turbines.

Finally, at its admission, the body only has two envelopes: an external body and an internal body.

This makes it possible to reduce transverse dimensions even more.

It should be observed that the third envelope which may sometimes be necessary for questions of operation with partial injection, is not required for supercritical turbines (250 bars, 565° C.) or for turbines having even higher characteristics (350 bars, 580° C.) that operate with total injection and sliding pressure.

In a preferred embodiment of the invention, the grooves of the drum rotor situated in the anterior internal body zone are longitudinal, and the moving wheels are separated by spacers having the same shape as the roots of the blades slid into the longitudinal grooves and facing the stationary stages which are constituted by one-piece diaphragms.

As for the portion of the rotor situated in the posterior internal body zone, it may be of conventional structure with disks for impulse turbines for carrying the moving blades, thereby presenting the advantage of having a limited number of stages.

This portion of the rotor may also be a drum rotor portion having circumferential grooves, thereby providing the specified advantages of a drum rotor.

An HP module having a drum rotor is described in French patent application No. FR-91 04 855 in the name of the Applicant.

For reasons of simplification, the posterior internal body is in two portion which may either be bolted together or else they may be banded together.

BRIEF DESCRIPTION OF THE DRAWINGS

The invention is now described in greater detail with reference to particular embodiments mentioned by way of example and shown in accompanying FIGS. 3 to 20.

MORE DETAILED DESCRIPTION

Figure 1:
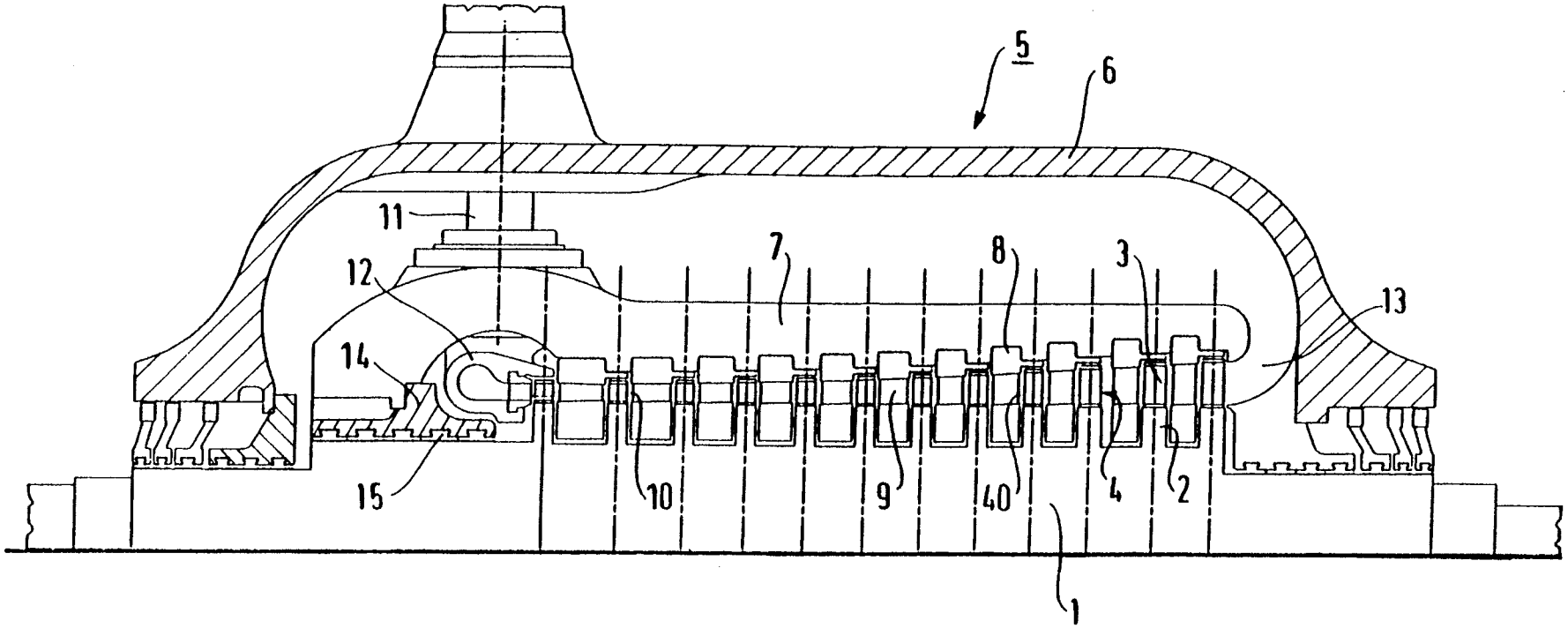
FIG.1 PRIOR ART
FIG. 1 is a longitudinal half-section through an HP module of a conventional impulse turbine.
Figure 2:
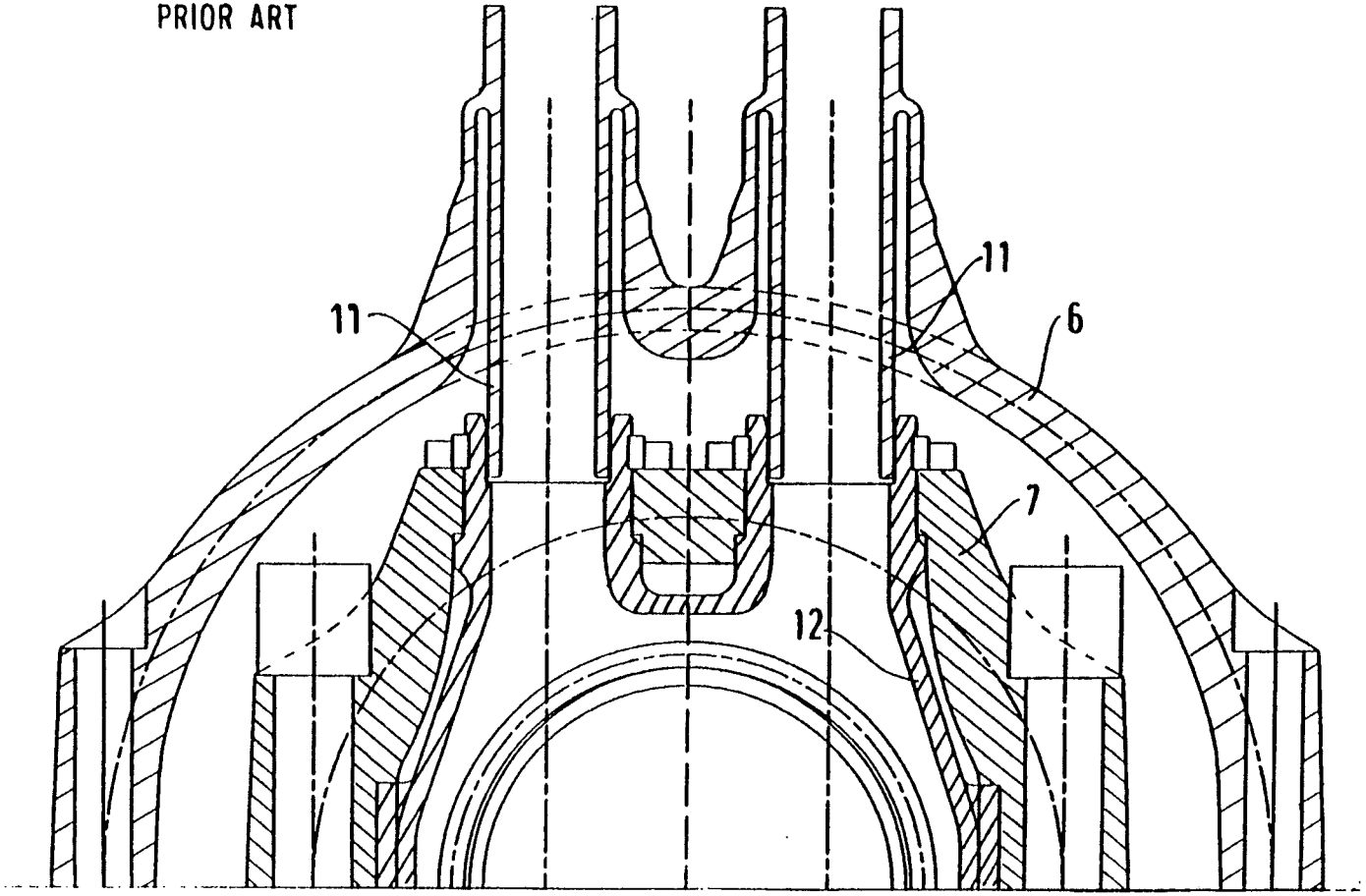
FIG.2 PRIOR ART
FIG. 2 is a radial half-section through the module of FIG. 1.

The HP module of a conventional impulse turbine (FIG. 1) comprises stator portions 5 and a rotor 1 fitted with disks 2 that support moving blades 3 which constitute moving wheels 4. The stator portions 5 include an external body 6 comprising two portions that are bolted together in the horizontal join plane and an internal body 7 supported by the external body 6 and which is likewise in two portions that are bolted together in the join plane. Diaphragms 8 are mounted inside the internal body 7 and are likewise in two portions, comprising stationary guide vanes 9 for the passage 10. Each diaphragm 8 constitutes the fixed portion of a stage 40 together with the following moving wheel 4.

The diaphragms 8 which are made in two portions to enable them to be assembled, are subjected to different stresses and deformations as a function of the azimuth under consideration. They need to be overdimensioned axially, particularly in the initial stages, so as to take account of said break at the horizontal join.

The module includes admission ducts 11 opening out into the internal envelope 12 inside the internal body used for distributing steam into the passage 10 which terminates in an exhaust 13.

The envelope 12 may be made in various different ways. It may be made in two portions which are plugged at the join and which are assembled together by bolting, or it may be made up of a plurality of steam injection nozzle carriers fixed on the internal body 7.

A baffle carrier 14 comprising two bolted-together portions is mounted on the internal body 7 around the admission end of the rotor 1 in such a manner as to be free to expand. The carrier is provided with baffles 15 that provide sealing between the internal body 7 and the rotor 1 at the admission end.

Figure 3:
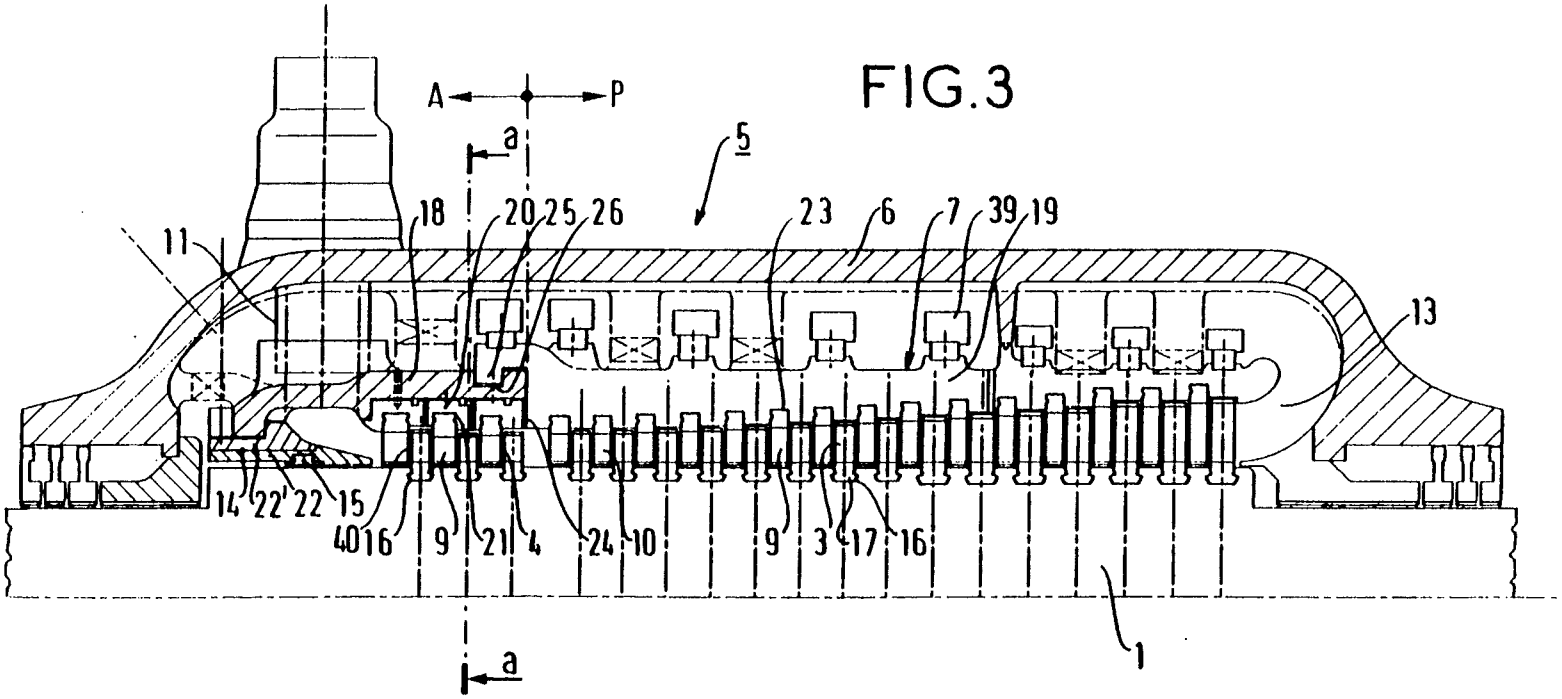
FIG. 3 is a longitudinal half-section through a first embodiment of a turbine module of the invention.

A first embodiment of the impulse turbine module is shown in FIG. 3.

The rotor 1 of the module is a drum rotor, i.e. without disks. It is provided with circumferential grooves 16 in which the roots 17 of movable blades 3 are received. Such a rotor is described in French patent application FR-A-91 04 855 in the name of the Applicant.

The external body 6 of the stator portions 5 of the module is of conventional structure and comprises two bolted-together portions.

The internal body 7 of the stator portions is split into two longitudinally coupled-together bodies, namely an anterior body 18 at the admission end and disposed in the anterior zone (zone A); and a posterior body 19 at the exhaust end 13 in the posterior zone (zone P).

The anterior body 18 is a single-piece body, i.e. it has no radial break and is thus entirely isotropic. It includes two half-rings 20 provided with grooves 21 in which the guide vanes 9 are slid one-by-one, each set of guide vanes 9 and the following moving wheels 4 constitutes a stage 40.

The anterior body 18 surrounds a baffle-carrier 14 mounted so as to be free to expand and including an external one-piece tube 22', i.e. a tube that has no radial break, and is therefore accurately isotropic, and which serves to band two half-rings 22 in which retractable baffles 15 are mounted, each occupying half a circumference. Naturally, there may be a plurality of baffles 15 in series. The baffles 15 provide sealing relative to the shaft of the rotor 1.

If it is desired to avoid making use of retractable baffles 15, the baffle carrier 14 which is mounted so as to be free to expand, no longer includes the half-rings, and is therefore constituted by a single piece only.

The posterior body 19 is made of two portions and it is coupled to the anterior body 18. It is isotropic and banded by bands 39. In tills designs, banding is total and easy to implement since the posterior internal body is entirely cylindrical and does not include any steam admissions.

Since the posterior body 19 is isotropic, the stationary portions of the passage 10 are guide vanes 9 mounted one-by-one without clearance at the break in the horizontal join in the grooves 23 of the internal body.

The posterior body 19 includes a front face 24 situated at the boundary between the zones A and P and against which the set of half-rings 20 in the zone A bears.

The front face 24 is extended by a circular rim 25 which is received in groove 26 formed in the periphery of the anterior body 18, thereby coupling the two bodies 18 and 19 together.

Figure 17:
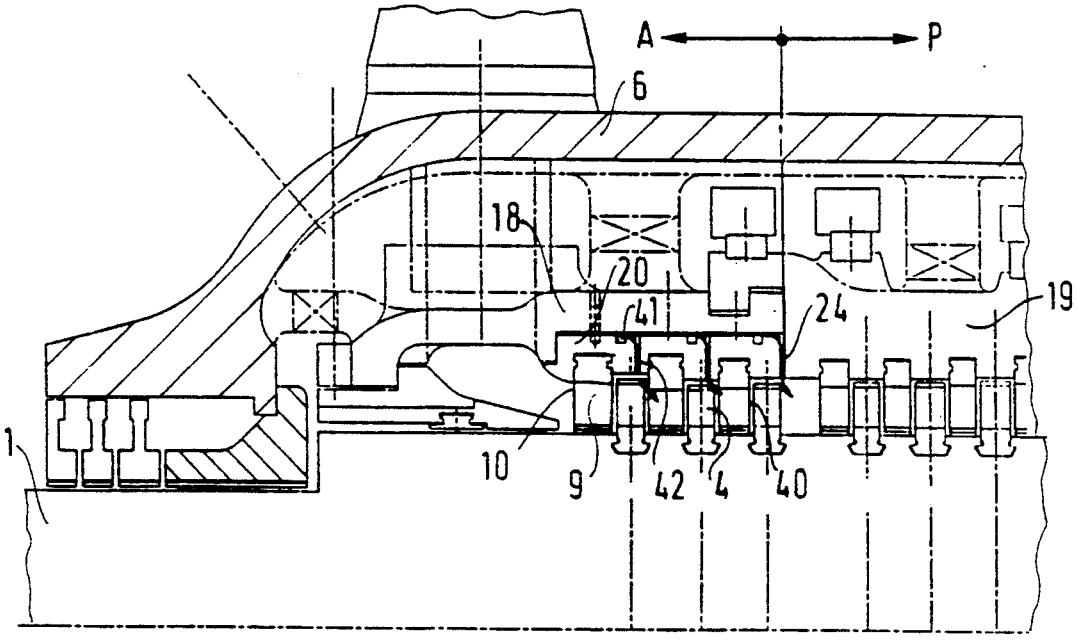
FIG. 17 is a detailed view of the anterior portion of FIG. 3.

For each stage 40, the half-rings 20 (FIG. 17) include a sealing segment 41 for preventing or slowing down the flow of steam into the annular space between the ring 20 and the anterior body. Such possible leakage is immediately recovered in the following stage by holes 42 so as to be sure that the leakage of the last stage of the zone A appears on the front face 24.

Figure 5:
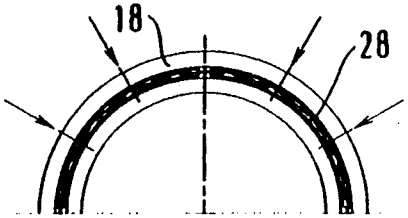
FIG. 5 is a radial section-through FIG. 4.
Figure 4:
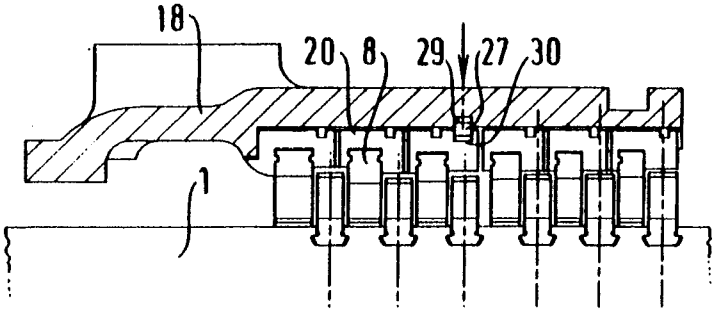
FIG. 4 is a longitudinal section through a variant of FIG. 3.

If the zone A includes too large a number of stages 40 (see FIGS. 4 and 5) an intermediate abutment 27 may be provided implemented in the form of a ring 28 including a plurality of sectors which are pushed from the outside of the anterior body 18 towards the inside thereof, with the sectors lying astride a circumferential groove 29 formed inside the anterior body 18, and a groove 30 formed on the outside of the half-rings 20.

In a variant of the invention (see FIG. 6) the zone A includes a drum rotor 1 whose grooves 31 are longitudinal.

In this design, as in impulse turbines, single-piece diaphragms 8 without interruption at the horizontal join and thus accurately isotropic are used as the fixed portions of the stages 40, said diaphragms having axial dimensions that are small.

The blades 3 are mounted axially on the rotor 1 in the grooves 31. Spacers 32 including sealing means relative to the diaphragms serve to fill the groove between the moving wheels 4. This makes it possible to install one-piece diaphragms 8 after installing each wheel 4 and spacer 32.

An end spacer 33 situated beneath the admission baffle carrier 14 locks the set of blades and spacers in the axial direction by means of a ring 34 screwed onto the rotor.

Figure 7:
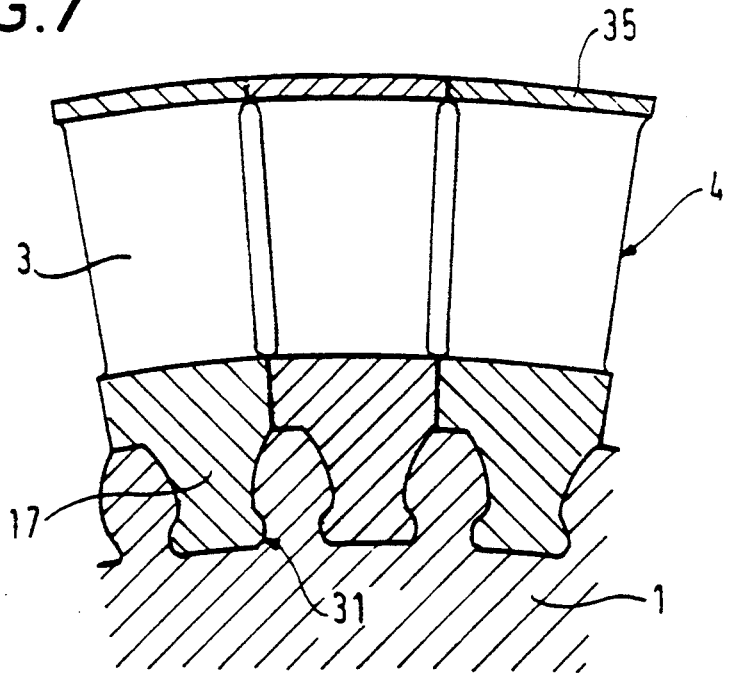
FIG. 7 is a section through a moving wheel of the FIG. 6 module.

FIG. 7 is a section a—a through a moving wheel 4 of the zone A.

The roots 17 of the blades 3 have respective swellings at their bases and they are exactly complementary to the longitudinal grooves 31.

The roots 17 of the blades 3 in a single moving wheel 4 touch one another above the grooves 31, and the caps 35 within a single wheel 4 are mounted so as to come into contact with one another.

Figure 8:
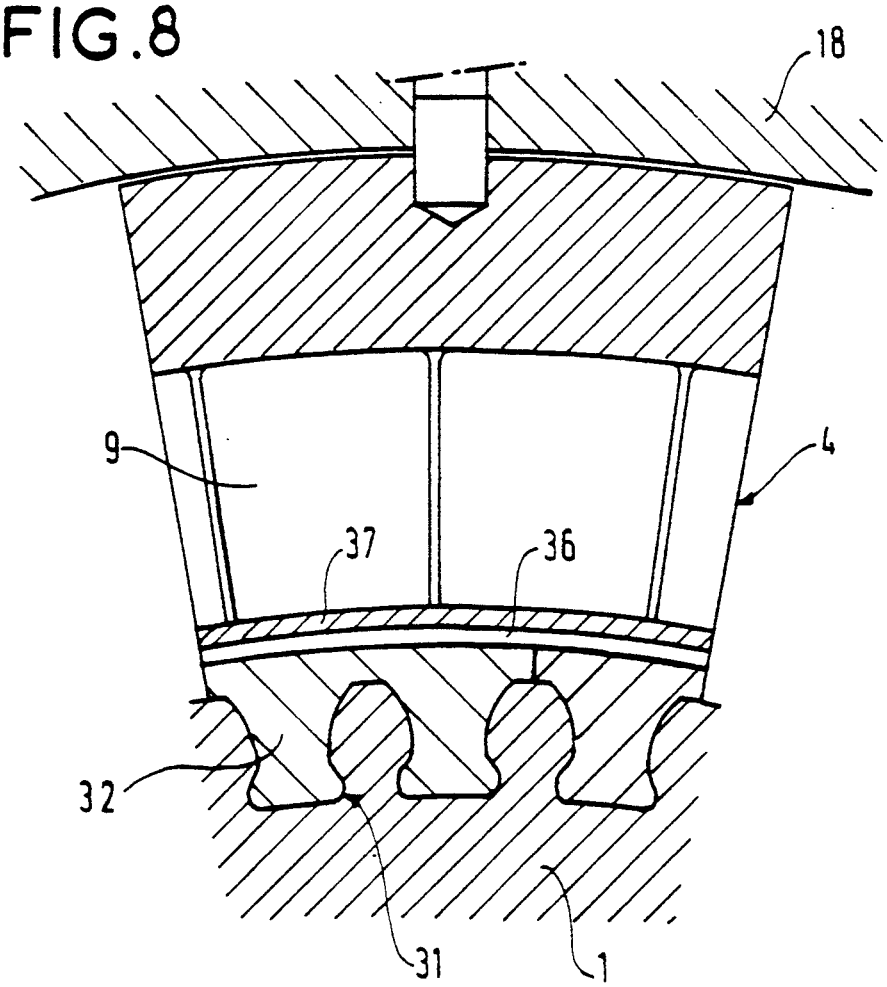
FIG. 8 is a section through a diaphragm of the FIG. 6 module.

Spacers 32 having the same shape as the roots 17 of the blades 3 are slid into each groove between two successive moving wheels 4 of blades 3 (see FIG. 8).

The spacers 32 may be separate or they may be connected together in bunches of three, four, or five. These spacers 32 or bunches of spacers come into contact with one another over the grooves 31.

The spacers 32 carry sealing means 36 facing the hubs 37 of the diaphragms 8.

Figure 18:
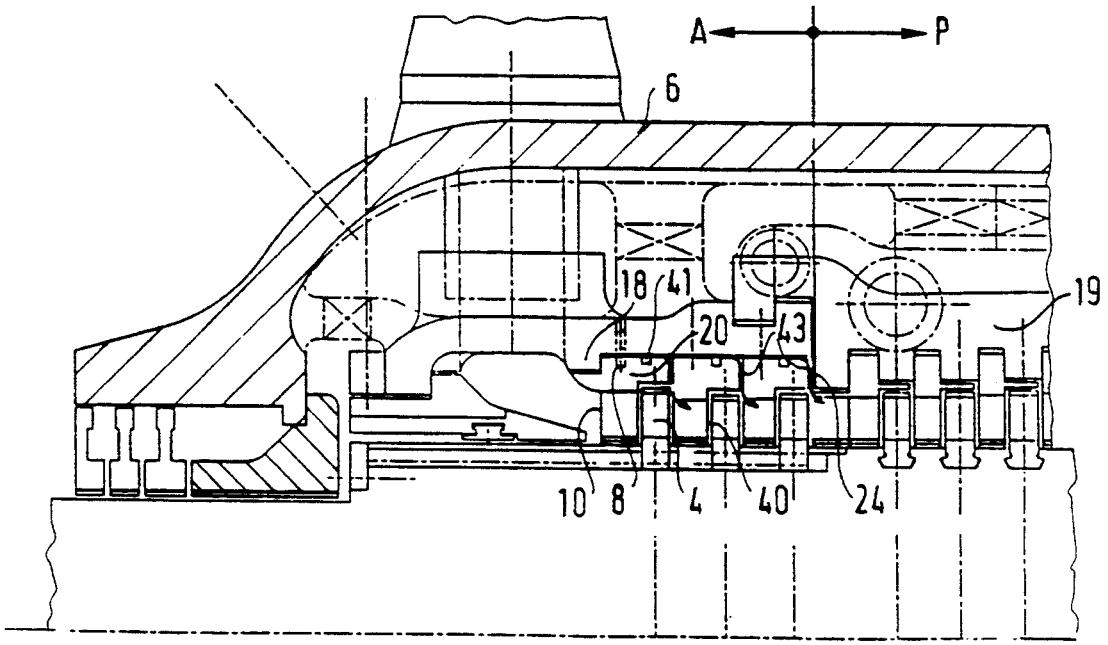
FIG. 18 is a detailed view of the anterior portion of FIG. 6.

Each diaphragm 8 of the zone A (see FIG. 18) includes a sealing segment 41 for each stage 40 for the purpose of preventing or reducing the flow of steam into the annular gap between the diaphragm 8 and the anterior body 18. Any such possible leak is immediately recovered at the following stage by grooves 43 so as to be sure that the leakage of the last stage of the zone A appears on the front face 24 (FIG. 18).

An impulse turbine having a drum rotor with longitudinal grooves is described in patent application FR-A-92 00 948 filed in the name of the Applicant on Jan. 29, 1992.

The posterior body 19 is constituted like that of FIG. 3 except that instead of being banded it is bolted, and is therefore not isotropic.

The diaphragms 8 constituting the stationary portions in the passage 10 are implemented in two portions each and they are mounted so as to be able to expand freely. This disposition makes it possible to conserve radial clearances better between the rotor and the stator when it is not isotropic.

Figure 6:
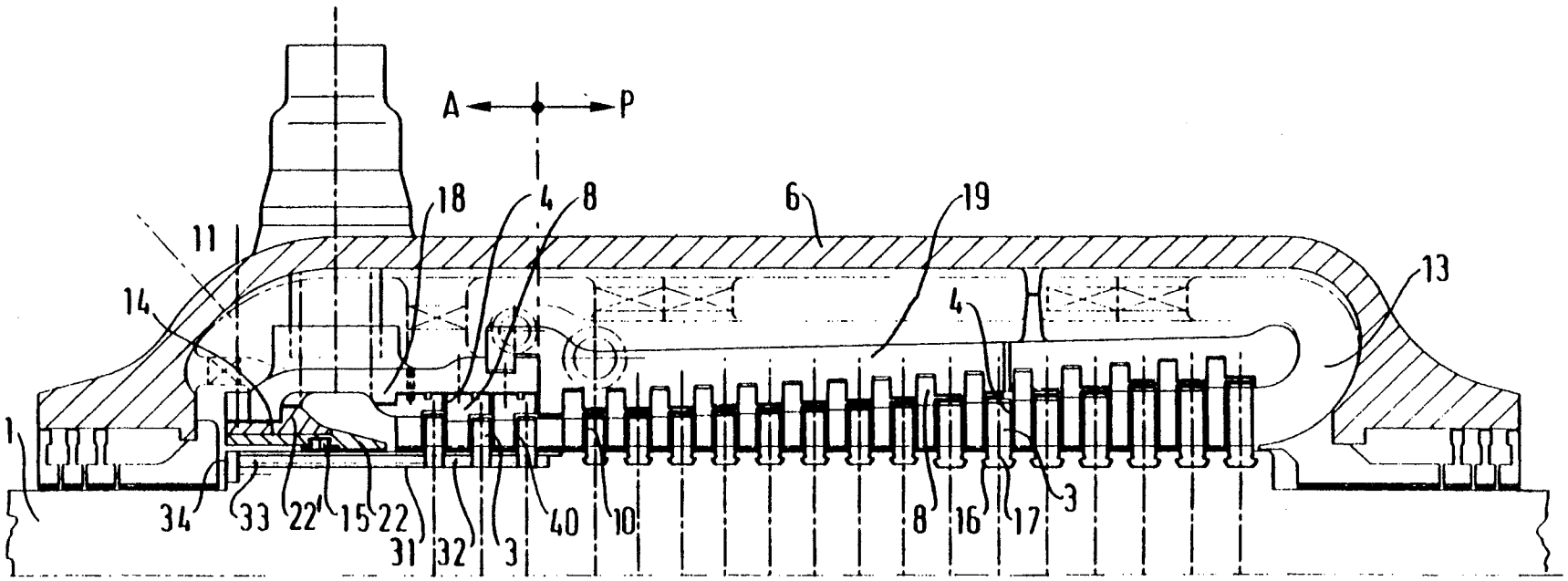
FIG. 6 shows a second embodiment of the turbine module of the invention.

The assemblies of the zones A and P are now described for the modules of FIGS. 3 and 6.

1. Assembly blades and fixed portions of the stages

ZONE A

Two situations arise depending on whether the grooves in the drum rotor are circumferential or axial.

A. Circumferentially mounted blades (FIG. 3)

Figure 9:
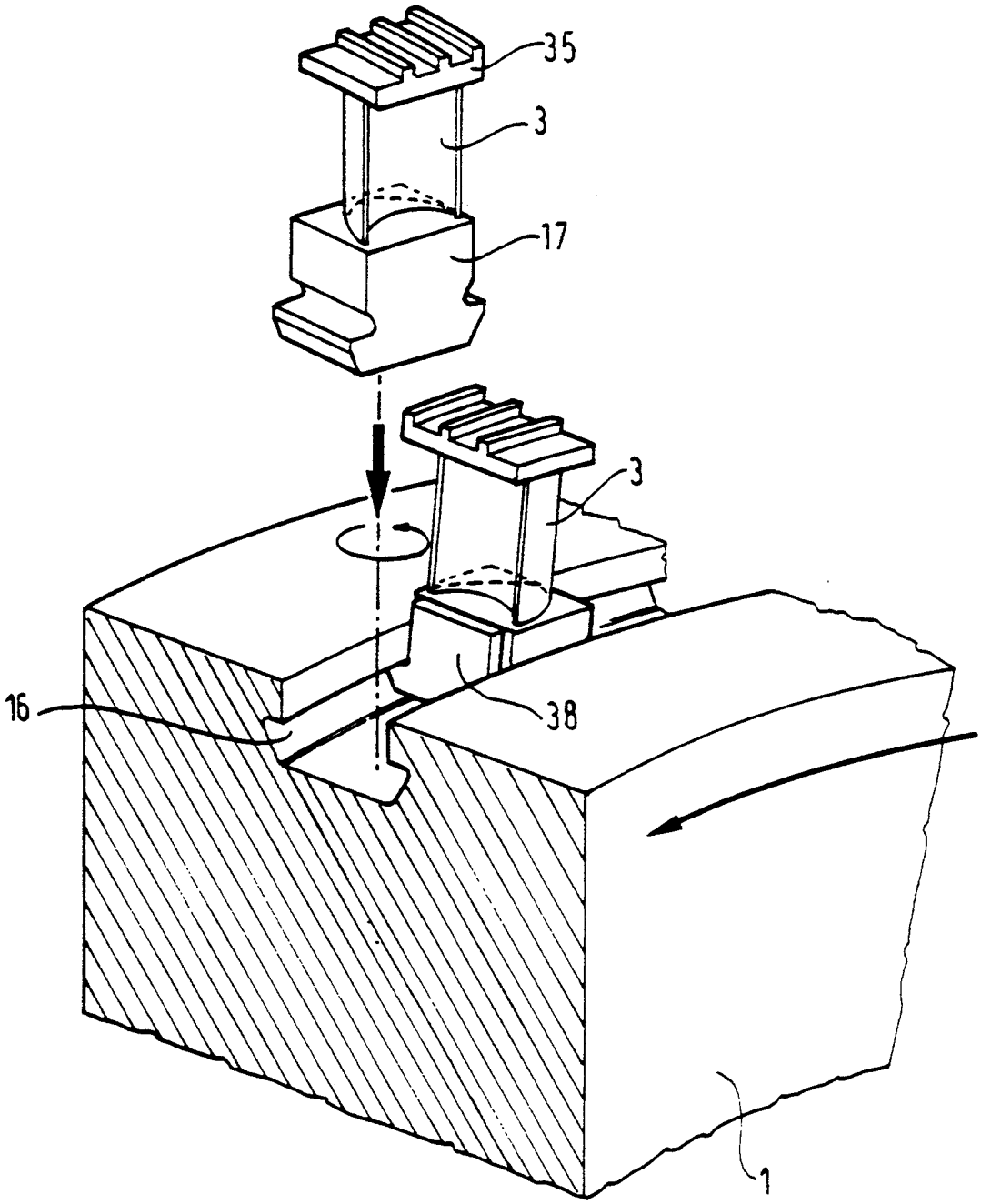
FIG. 9 shows how the blades are mounted circumferentially.

Each moving blade 3 includes a root 17 in the form of an upsidedown T. The root 17 of the blade 3 is inserted in the upsidedown T-shaped circumferential groove 16 and it is then pivoted. Once all of the blades 3 have been installed, wedges 38 are inserted that have the same section as a root 17 of a blade 3 but that are much thinner (see FIG. 9). The last wedges 38 are split in two in the vertical direction so as to be capable of being inserted, and the very last wedge is split into three segments.

Figure 10:
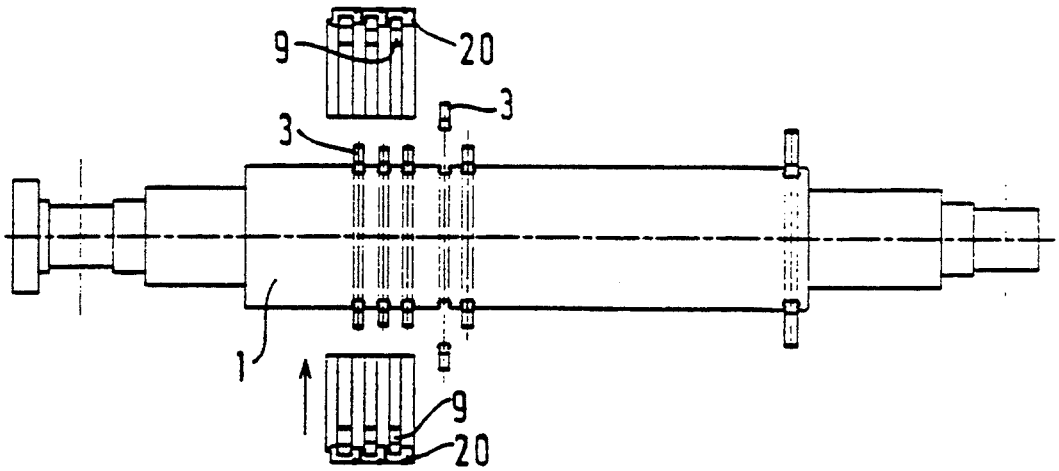
FIGS. 10, 12, and 14 show three steps in assembling the module of FIG. 3.

In the general case, clearance remains between the caps. Thereafter, the stationary vanes 9 are fixed in the half-rings 20 and the half-rings 20 are mounted around the bladed rotor 1 while being temporarily held in place by screws prior to installation in the anterior body 18 (see FIG. 10).

B. Axially mounted blades (FIG. 6)

Each moving wheel 4 is fully installed together with its own clamping on the rotor 1 by being slid axially, and single-piece diaphragms 8 and spacers 32 in the longitudinal grooves 31 are mounted between successive moving wheels 4 (see FIGS. 7 and 8).

Figure 11:
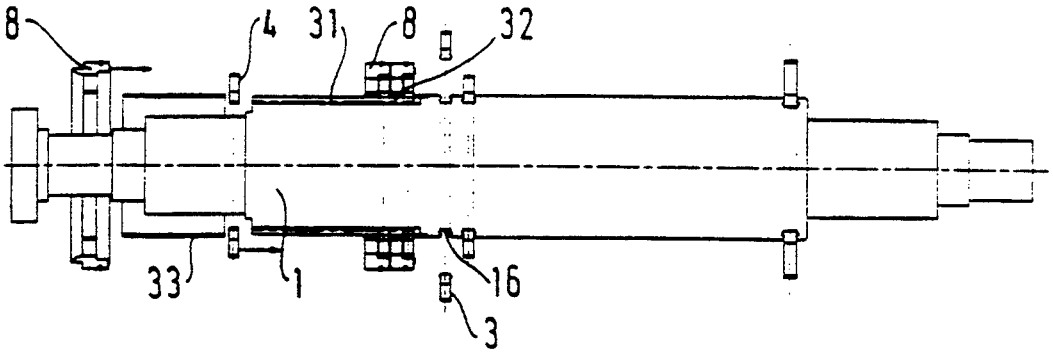
FIGS. 11, 13, and 15 show three steps in assembling the module of FIG. 6.

The procedure terminates with the end spacer 33 and the ring 34 which is screwed to the rotor 1 (see FIG. 11).

ZONE P (see FIGS. 3 and 6)

In zone P, the rotor blades 3 are mounted circumferentially, with the grooves 16 in the drum rotor 1 therefore being circumferential in this zone.

It is not impossible to mount the blades axially in said zone, but it is more complex, in practice.

Assembly takes place as described above (see FIG. 9).

As described, two embodiments of the stationary portions in the passage 10 can be provided in the zone P depending on whether the posterior body 19 is bolted or banded, and the ways in which said stationary stages are assembled will be different, as explained above for stator assembly.

Figure 19:
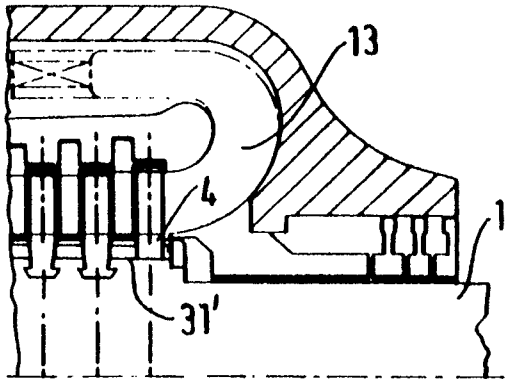
FIG. 19 shows a variant of the posterior portion of the rotor of FIGS. 3 and 6.

Provision may be made for the last moving wheel 4 of the rotor (at its exhaust end) to be installed axially in longitudinal grooves 31' (see FIG. 19), thereby improving vibration problems.

2. Stator assembly

Figure 12:
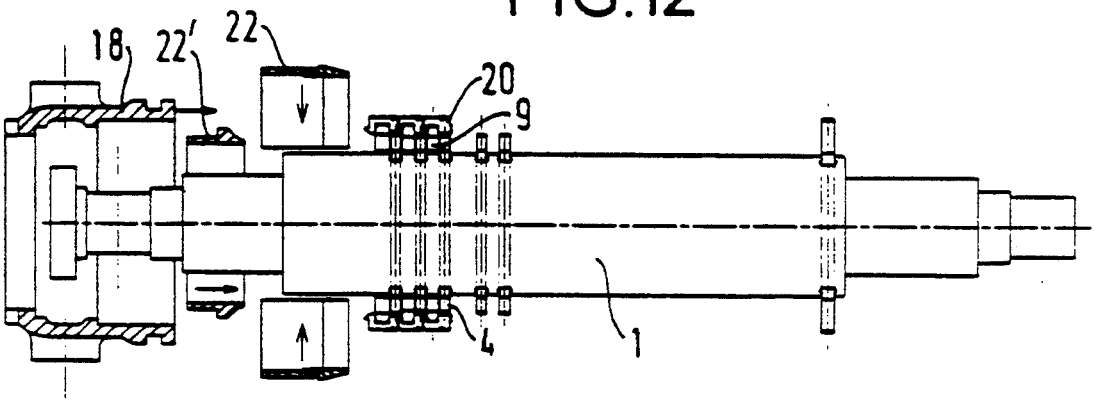
Figure 14:
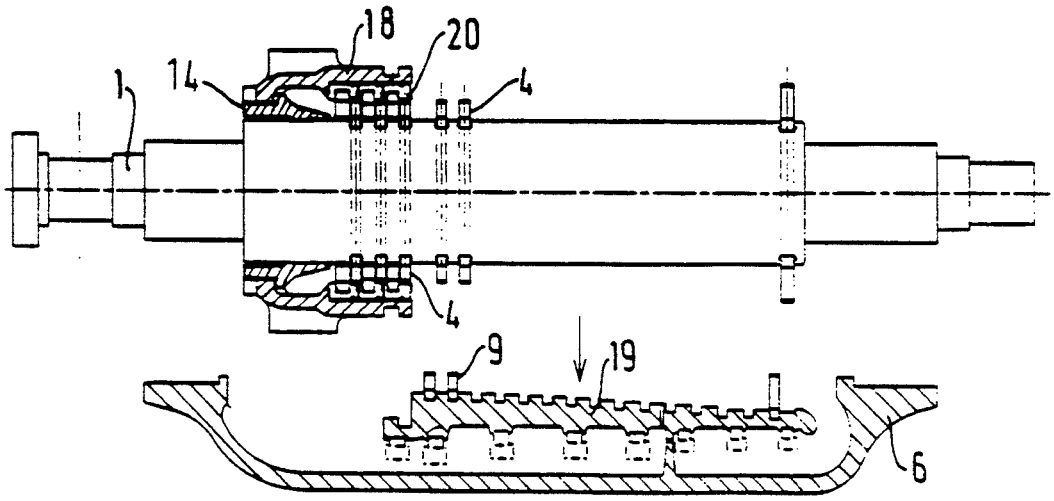
Figure 13:
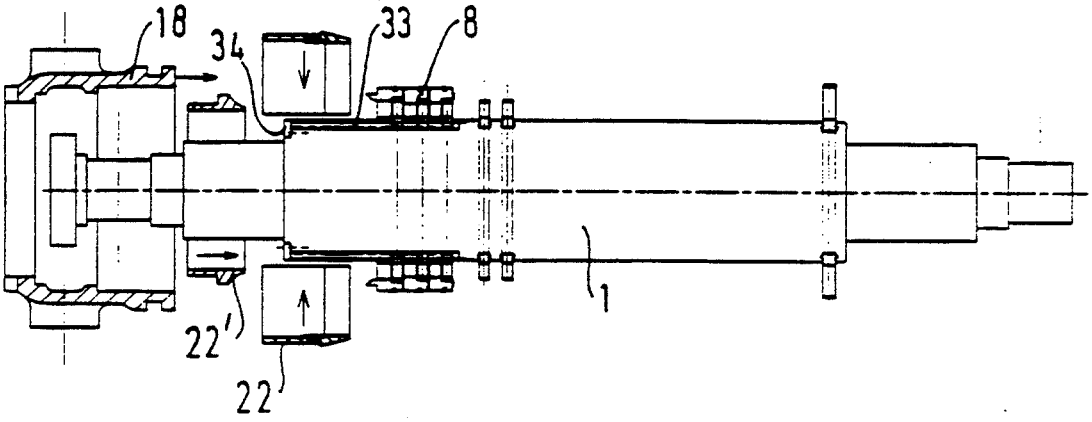
Figure 15:
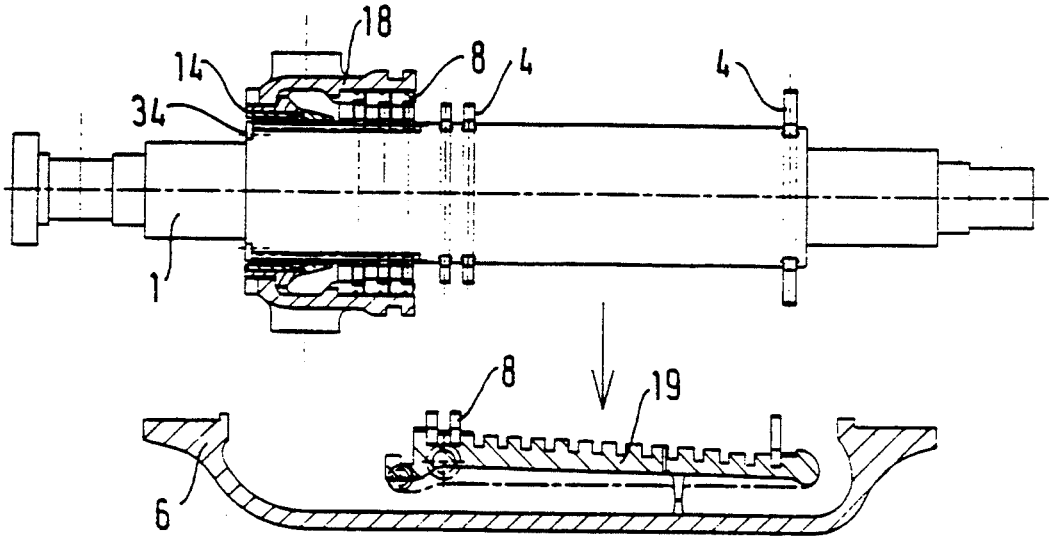

ZONE A (see FIGS. 12 and 13)

In zone A, the internal body 18 and the baffle carrier 14 are assembled identically regardless of the way in which the blades are assembled (axially or circumferentially).

It has already been specified that these two parts are isotropic and do not have any radial break.

The sets of blades 4 and the diaphragms 8 or guide vanes 9 of the zone A are mounted on the rotor 1 as described above.

The baffle carrier 22' which includes an outer tube banding together two half-rings 22 that carry the retractable baffles 15 is threaded over and centered on the internal body 18 by keys that are external to the internal body 18.

This assembly is then threaded onto the admission end of the rotor 1.

The diaphragms 8 (FIG. 13) or the ring 20 carrying the guide vanes 9 (FIG. 12) are then centered by the outside of the anterior body 18 by pegs and are thus mounted free to expand.

Figure 16:
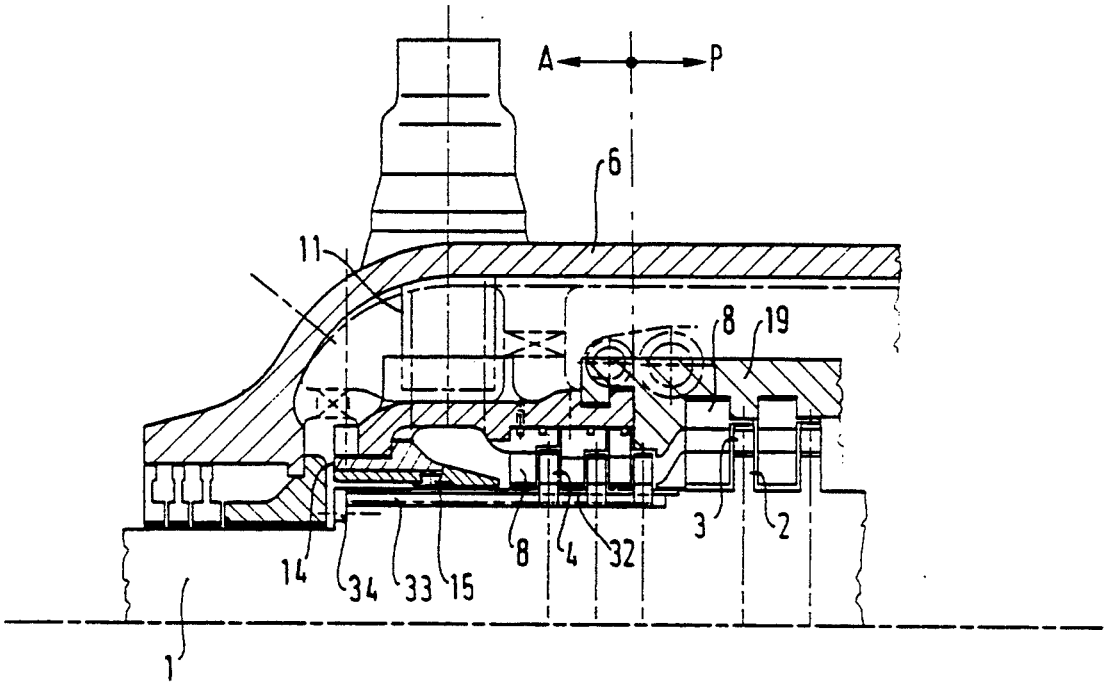
FIG. 16 shows a third embodiment of the turbine module of the invention.

This type of assembly is necessary for building purposes, but given the isotropic anterior body 18, it is not necessary from the design point of view. It should be observed that if the baffle carrier 14 does not include retractable baffles 15, it is entirely constituted by a single piece (FIG. 16).

ZONES P (FIGS. 3, 10, 12, 14) and (FIGS. 6, 11, 13, 15)

The lower anterior body 18 includes its diaphragms 8 (FIG. 6) or guide vanes 9 (FIG. 3) and is in place in the lower external half-body 6.

The assembly comprising the rotor 1 and the anterior body 18 of the zone A is mounted in the lower external body 6 while taking the following precautions:

the rotor 1 bears against its bearings; and the anterior body 18 bears against the admission end of the external body 6 and is coupled to the posterior half-body 19.

Thereafter, the top posterior half-body including its half-diaphragms 8 (FIG. 6) or guide vanes 9 (FIG. 3) is then put into place on the above assembly.

The upper posterior half-body 2 is then bolted (FIG. 15) or banded (FIG. 14) depending on the selected design.

The upper external half-body is then assembled and bolted into place.

In a variant for impulse steam turbines, it would be possible to use a rotor 1 having completely conventional disks 2 in its zone P.

Such a disposition makes it possible to reduce the number of stages 4, 8 in the zone P.

In contrast, the rotor in the zone A is naturally a drum rotor for use with axial or circumferential assembly; FIG. 16 shows the blades 3 as being installed axially.

The posterior body 19 of the zone P may be like the zones P of the modules described above, i.e. it may be bolted or banded.

Figure 20:
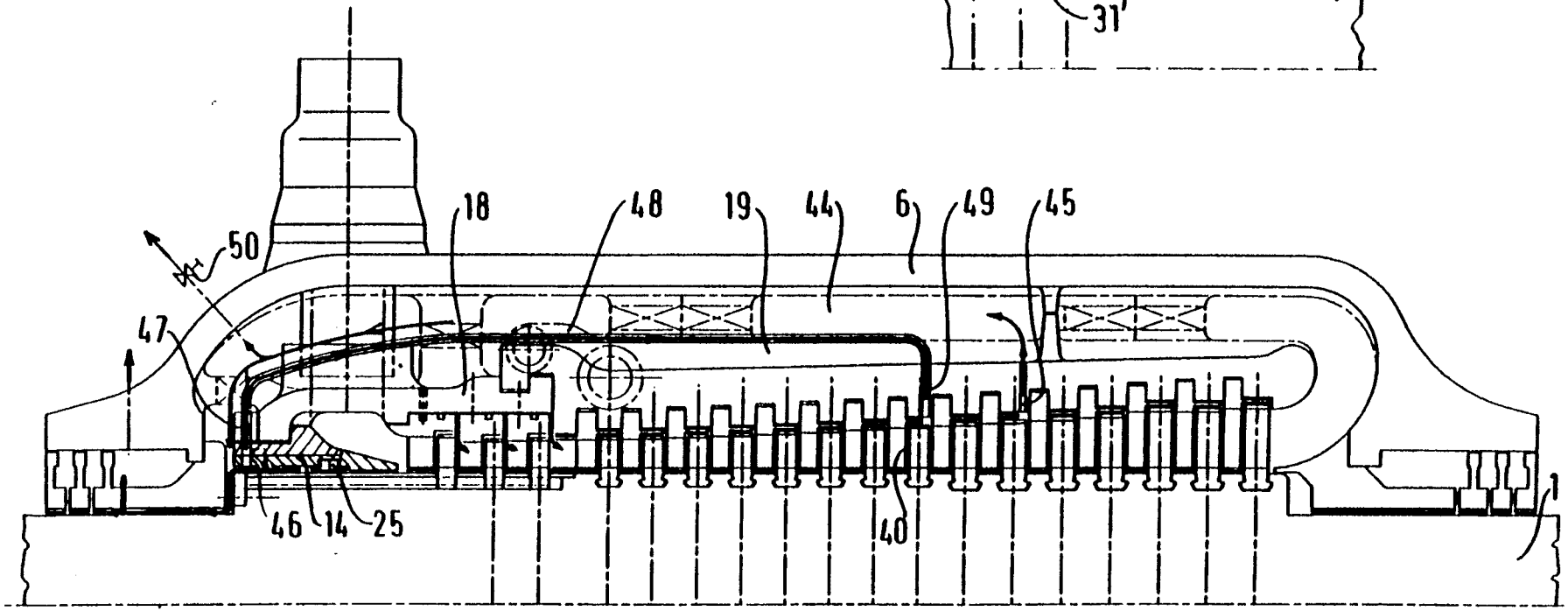
FIG. 20 shows the air conditioning of the modules of FIGS. 3 and 6.

It is possible to provide for cold steam to sweep through the inter-stator space 44 (see FIG. 20). To this end, samples are taken from one of the last stages 40 of the zone P via slots 45.

Leaks of hot steam that have passed through the baffles 25 are taken from the front of the baffle carrier 14 via slots 46 formed in said baffle carrier.

The slots 46 are extended by slots 47 passing through the one-piece anterior body 18 and by ducts 48 passing through the inter-stator space and feeding a stage of the zone P via slots 49, thereby preventing hot steam from escaping from the front portion of the anterior body, and also causing the hot steam that escapes to do work. Value means 50 may be used to control a leak of cold steam to the outside of the inter-stator space 44, thereby enabling the temperature of said space to be controlled and optionally making it possible to cool the rotor of some other module (e.g. an MP module).

I claim:

1. A high pressure module for a multistage impulse turbine, said module including an admission for steam having very high temperature and pressure, an exhaust for said steam, a rotor supporting moving wheels constituted by moving blades, a stator including an external body and an internal body supporting stationary stator portions comprising stationary vanes co-operating with the moving wheels to constitute multiple turbine stages, said internal body being provided at an admission end with a baffle carrier surrounding the rotor and independent of the internal body, said internal body comprising an anterior body disposed at the admission end of the internal body, coupled to a posterior body disposed at an exhaust end; said anterior body being a single piece and surrounding a portion of the rotor, said rotor being a drum rotor situated in a zone of the anterior body and provided with grooves, said moving blades comprising roots, said roots of said moving blades being fixed in said grooves, said grooves of the drum rotor situated in the zone of the anterior body are longitudinal grooves, and the moving wheels being situated in the zone of the anterior body and being separated by spacers having the same shape as the roots of the blades, and said spacers being slid into the longitudinal grooves and facing said stationary vanes constituted by single-piece diaphragms, and said roots of said moving blades having a complementary shape to that of said longitudinal grooves.

2. A high pressure module for a turbine according to claim 1, wherein the baffle carrier is entirely constituted by a single piece.

3. A high pressure module for a turbine according to claim 1, wherein the baffle carrier includes an external single-piece tube surrounding two half-rings each carrying one or more retractable baffles.

4. A high pressure module for an impulse turbine according to claim 1, wherein each diaphragm in each of the multiple turbine stages is provided with a sealing segment providing sealing between said diaphragm and the anterior body, and wherein said diaphragm is provided with a groove for delivering leakage steam into a following one of said multiple turbine stages.

5. A high pressure module for a turbine according to claim 1, wherein a portion of the rotor is surrounded by the posterior internal body and is a drum rotor and is provided with circumferential grooves, and wherein the roots of the moving blades constituting the moving wheels are respectively received in said circumferential grooves.

6. A high pressure module for a turbine according to claim 5, wherein the posterior internal body is made up of two portions bolted together in a join plane, said posterior internal body including diaphragms that are made in two portions, constitute the stationary vanes of said multiple turbine stages.

7. A high pressure module for a turbine according to claim 5, wherein the posterior internal body is constituted by banded portions in which the stationery vanes constituting the multiple turbine stages are located.

8. A high pressure module for a turbine according to claim 1, wherein a rotor portion is surrounded by the posterior internal body and is a drum rotor, and a last moving wheel of said rotor portion is installed in longitudinal grooves formed in said rotor portion.

9. A high pressure module for a turbine according to claim 1, wherein the portion of the rotor situated in a zone of the posterior internal body is provided with disks, and said moving blades constituting the moving wheels are mounted respectively on said disks.

10. A high pressure module for an impulse turbine according to claim 1, further including means for channelling leaks of hot steam escaping from the baffle carrier and means for injecting said hot steam leaks into the posterior body, and means for taking relatively cold steam from inside the posterior body and for injecting said cold steam into an inter-stator space situated between said anterior body and said posterior body and the external body, whereby said cold steam is suitable for cooling a rotor of another module.

* * * * *